US005981893A

United States Patent [19]

Bleiker et al.

[11] Patent Number: 5,981,893

[45] Date of Patent: Nov. 9, 1999

[54] ELECTRICAL SWITCHING DEVICE

[75] Inventors: Daniel Bleiker, Zürich; Jadran Kostovic, Neuenhof; Herbert Schifko, Glattbrugg, all of Switzerland

[73] Assignee: Asea Brown Boveri AG, Baden, Switzerland

[21] Appl. No.: 08/935,053

[22] Filed: Sep. 22, 1997

[30] Foreign Application Priority Data

Nov. 25, 1996 [DE] Germany ..... 196 48 633

[51] Int. Cl.[6] ..... H01H 33/18; H01H 33/70; H01H 33/82

[52] U.S. Cl. ..... 218/48; 218/123

[58] Field of Search ..... 218/1, 7, 42, 45, 218/46, 48, 50, 57–58, 59–67, 78, 84–88, 120, 141, 146, 153, 154, 29

[56] References Cited

U.S. PATENT DOCUMENTS

| | | | |
|---|---|---|---|
| 3,399,286 | 8/1968 | Kerr, Jr. | 218/154 |
| 4,152,560 | 5/1979 | McCloud et al. | 218/14 |
| 4,644,118 | 2/1987 | Gengenbach et al. | 218/7 |

FOREIGN PATENT DOCUMENTS

| | | |
|---|---|---|
| PA147532 | 5/1966 | Germany . |
| 2064037 | 3/1972 | Germany . |
| 4212740C2 | 2/1997 | Germany . |

*Primary Examiner*—Lincoln Donovan
*Attorney, Agent, or Firm*—Burns, Doane, Swecker & Mathis, L.L.P.

[57] ABSTRACT

This switching device has a contact arrangement which is equipped with erosion-resistant contacts and comprises at least one contact which moves along a central axis (2) and at least one mating contact which is provided for receiving the moving contact. One of the two contacts has a finger cage (25) which is provided with individual, sprung contact fingers (13) which are spaced apart from one another by radial slots (26) extended in the direction of the central axis (2). Means are provided which prevent the side edges (29) of the contact fingers (13) being able to touch in the region of the contact surfaces (27) in the front part of the contact fingers (13) when said contact fingers (13) are drawn together in the direction of the central axis (2) , such that welding of the edges (29) of the contact fingers (13) cannot occur.

9 Claims, 3 Drawing Sheets

ELECTRICAL SWITCHING DEVICE

BACKGROUND OF THE INVENTION

1. Field of the Invention

The invention is based on an electrical switching device according to the preamble of claim 1.

2. Discussion of Background

The short-circuit currents which occur in high-voltage switchboards in the event of a fault and must be coped with by switching devices, in particular by quick-action grounding devices as well, are becoming ever larger, so that attention must increasingly be paid to increasing the life of the contact arrangements in these switching devices. Contact arrangements are known which are provided with finger cages. The individual contact fingers are subject to electrodynamic forces which are becoming ever larger as the rating of the high-voltage switchboards increases. If in addition to these electrodynamic forces, stresses also arise from arc effects, so that it is possible for welding to occur between the adjacent contact fingers in the finger cage. Such welding prevents the insertion of the mating contact into the finger cage, that is to say the switching device drive has to be equipped with considerable power reserves which make it possible to break these welds in all circumstances. Such a drive, which is equipped with a power reserve as a precautionary measure, is comparatively expensive.

SUMMARY OF THE INVENTION

Accordingly, one object of the invention, as it is described in patent claim 1, is to provide a novel electrical switching device in which the side edges of contact fingers arranged in a finger cage cannot be welded as a consequence of electrodynamic forces in conjunction with arc effects.

Such a contact arrangement which is designed to be proof against welding means that the drive of the switching device can be designed to be weaker, and can thus be produced more cheaply. Furthermore, the life of the contact arrangement according to the invention is advantageously increased, so that longer maintenance intervals are possible, which advantageously increases the availability of the switching device.

In a preferred embodiment of the invention, slots with decreased widths are provided between the contact fingers. The mean diameter of the finger cage has a ratio of about 100:1 to the width of the slots originating from the base of the contact fingers. The mean diameter of the finger cage in this case has a ratio of about 1:3 to the length of the contact fingers. This arrangement has the advantage that the contact fingers cannot touch metallically in the region of their tips, so that welding of the side edges of the contact fingers cannot occur, even as a result of arc effects.

An exemplary embodiment of the invention and the advantages which can be achieved by it are explained in more detail in the following text with reference to the drawing, which illustrates only one possible embodiment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only those elements which are required for direct understanding of the invention are illustrated.

DESCRIPTION OF THE PREFERRED EMBODIMENTS

Figure 1:
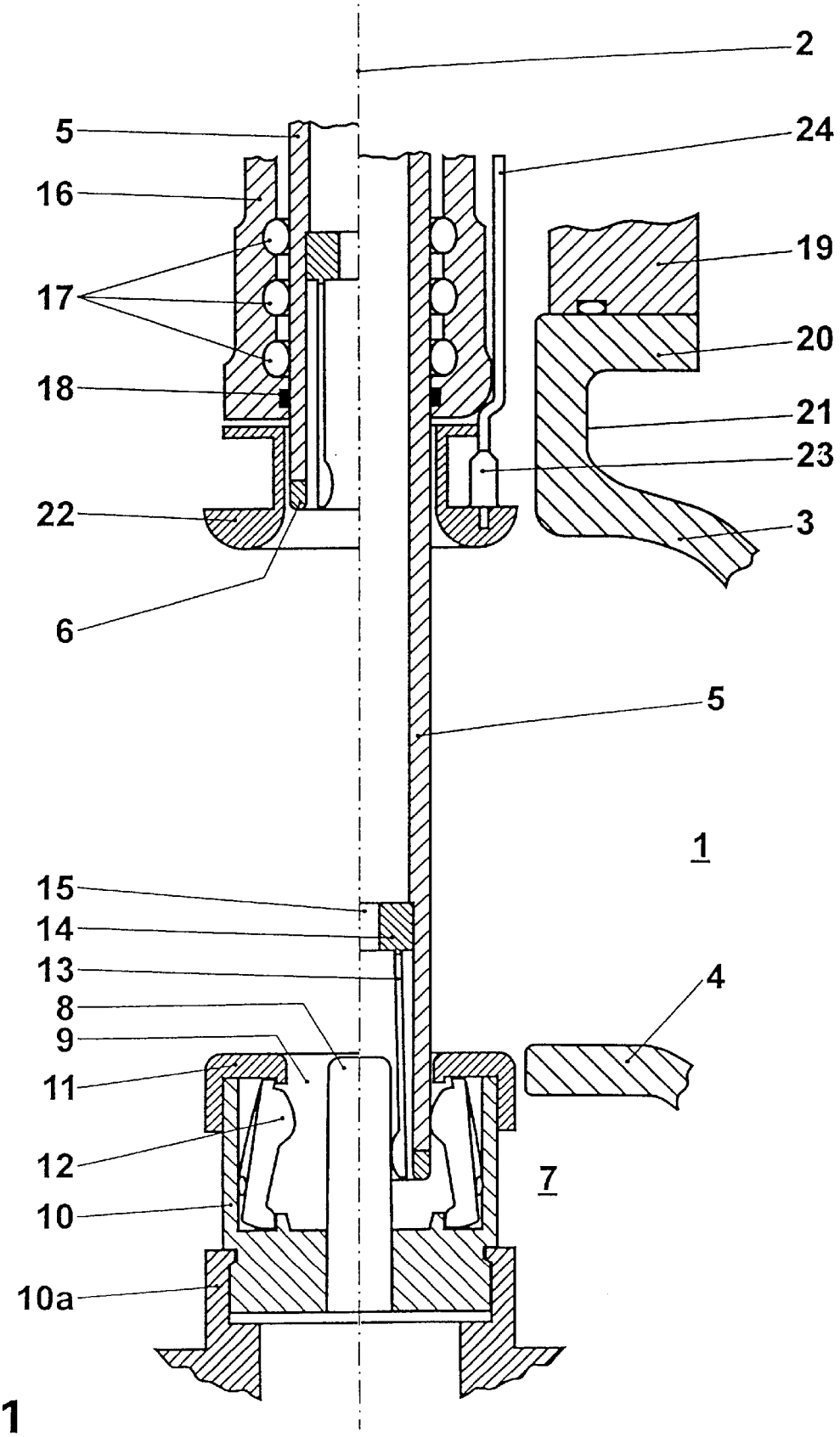
FIG. 1 shows a partial section through a first electrical switching device according to the invention.

Referring now to the drawings, wherein like reference numerals designate identical or corresponding parts throughout the several views, metal-encapsulated, gas-insulated switchboards are, as a rule, equipped with grounding switches, which are called grounding devices, and/or are equipped with quick-action grounding switches, which are called quick-action grounding devices. The use of such grounding devices and quick-action grounding devices has been proven for a long time. FIG. 1 illustrates a quick-action grounding device 1 which is driven by a drive (not illustrated). The quick-action grounding device 1 extends along a central axis 2 between the grounded metallic encapsulation 3 of the gas-insulated switchboard and the active part 4 of the switchboard, to which high voltage is applied in operation. The left-hand half of FIG. 1 illustrates the quick-action grounding device 1 in the disconnected state, and the right-hand half illustrates it in the connected state. The quick-action grounding device 1 has a cylindrical, moving contact tube 5 which is driven by a drive (which is not illustrated), but is arranged outside the encapsulation 3. The tip 6 of the contact tube 5 facing the active part 4 can be provided with erosion-resistant material, for example with tungsten copper. During connection, the contact tube 5 is moved along the central axis 2 towards a mating contact 7, which is incorporated in the active part 4 such that it is fixed. The mating contact 7 is designed cylindrically about the central axis 2.

In the center, the mating contact 7 has a contact pin 8 which can be provided on the side facing the moving contact tube 5 with a cylindrical cap made of electrically conductive, erosion-resistant material. The contact pin 8 is surrounded by an annular gap 9 which is provided to receive the moving contact tube 5. The annular gap 9 is bounded on the outside by an electrically conductive contact mounting 10. The contact mounting 10 is electrically conductively connected to the active part 4 by means of an adapter 10*a*. This contact mounting 10 is provided on the side facing the moving contact tube 5 with a cover 11 which is designed to have good dielectric properties and is manufactured from electrically conductive, erosion-resistant material. Sprung contact elements designed as contact fingers 12 are inserted in the side of the contact mounting 10 facing the contact tube 5.

The moving contact tube 5 is tubular and its tip 6 facing the mating contact 7 is formed such that contact fingers 13 which are fitted in a sprung manner in the interior of the moving contact tube 5 are dielectrically shielded. During connection, the contact fingers 12 run on the contact tube 5 and slide on its outer surface. A volume which receives the contact pin 8 during connection is provided in the interior of the contact tube 5. The contact pin 8 has a surface on which the contact fingers 13 rest after connection of the quick-action grounding device. The contact fingers 13 are held together at their base by a holder 14 which is mounted concentrically in the interior of the contact tube 5. The holder 14 and the contact fingers 13 can be manufactured from one part, but it is, for example, also possible for the ends of the individual contact fingers 13 to be soldered into the holder 14. In the center, the holder 14 has a through-hole 15 which is used to dissipate any pressure surges which form in the region of the connection arc. A receptacle for a tool is also incorporated in the inner wall of the hole 15, with the aid of which tool the holder 14 can be screwed concentrically into the contact tube 5.

The contact tube 5 is guided on the side of the grounded encapsulation 3 in a metal sleeve 16 in which spiral contacts 17 are arranged, which are provided to carry current from the contact tube 5 to this metal sleeve 16. Mechanical overloading of the spiral contacts 17 is prevented by guide rings 18 made of an insulating material. The metal sleeve 16 is electrically conductively connected to a metal flange 19 which is connected electrically conductively and in a pressure-tight manner, to the flange 20 of a connecting stub 21 which is inserted into the grounded encapsulation 3. The quick-action grounding device drive is screwed in a pressure-tight manner to the metal flange 19, so that the opening in the connecting stub 21 is completely sealed.

The metal sleeve 16 is dielectrically shielded by means of a shield 22 on the side facing the mating contact 7. This shield 22 is rigidly connected to the metal sleeve 16, this connection (which is not illustrated) being designed to be electrically insulating. In operation, the shield 22 is at a freely floating potential that is somewhat different from the ground potential of the metal sleeve 16. This potential difference is comparatively small, so that the dielectrical effectiveness of the shield 22 is nevertheless completely ensured. As a result of this free potential, which differs from ground potential, a sensor 23 which is mounted on the shield 22 for measurement purposes can be inserted into the switchboard while it is live. The sensor 23 has a connecting cable 24, which is generally coaxial and is passed out of the encapsulation 3 in a pressure-tight manner.

The sensor 23 can be designed, for example, to confirm that the active part 4 is not live before the quick-action grounding device 1 is switched on or, alternatively, it can be used, inter alia, to detect the occurrence of partial-discharge pulses. As a rule, both of these are measurements which do not depend on the precision of the measurement results. However, these measurement results can advantageously be processed for control engineering purposes relating to the present, metal-encapsulated, gas-insulated switchboard to provide statements about the respective operating condition of the switchboard, so that it is possible to improve the operating safety and reliability, and thus the availability of the switchboard, in a simple and cost-effective manner.

Figure 2:
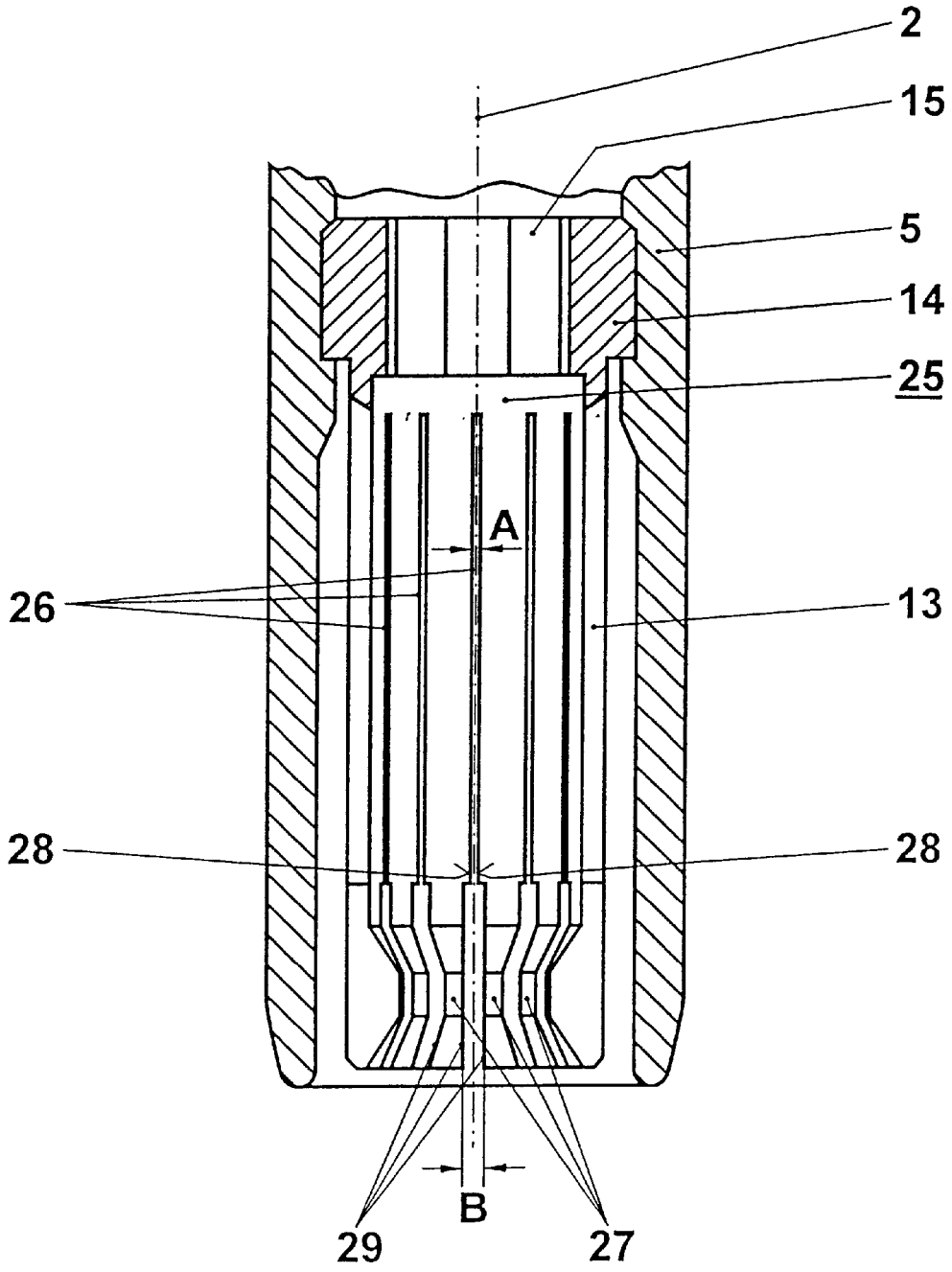
FIG. 2 shows a partial section through a first design variant of a contact arrangement of the electrical switching device.

FIG. 2 shows a partial section through the side of the contact tube 5 facing the mating contact 7. The holder 14 and the sprung contact fingers 13 integrally formed on it are illustrated as one item here, but they can also be assembled from different parts. In the case of this design variant of the moving contact arrangement of the quick-action grounding device 1, the contact fingers 13 are arranged in the form of a cylindrical finger cage 25. This finger cage 25 is mounted concentrically with respect to the central axis 2 in the interior of the contact tube 5. In the region of the straight part of the contact fingers 13, the finger cage 25 has an external diameter and an internal diameter, such that the mean diameter is between these diameters. Slots 26 which run radially with respect to the central axis 2 are produced between the individual contact fingers 13 and allow the contact fingers 13 to be sprung individually and independently of one another. Originating from the holder 14, that is to say on the base of the contact fingers 13, these slots 26 initially have a comparatively small width A. In the region of the tips of the contact fingers 13, where the latter are thickened into spherical shapes and where they have the contact surfaces 27 pointing toward the central axis 22, the slots 26 then have a width B. The width B is considerably greater than the width A. The slots 26 with the comparatively very small width A are advantageously produced by means of a laser cutting process since conventional cutting processes create a greater width. The slots 26 whose width is A have side edges 28. The transition from the width A to the greater width B of the slots 26 may be sudden or gradual, depending on the cutting process used. The slots 26 with the width B have side edges 29.

The mean diameter of the finger cage 25 is in this case chosen to be about one hundred times greater than the width A of the slots 26 originating from the base of the contact fingers 13, but smaller slot widths are possible. The mean diameter of the finger cage 25 accordingly has a ratio of about 100:1 to the width A of the slots 26 originating from the base of the contact fingers 13. The mean diameter of the finger cage 25 also has a ratio of about 1:3 to the length of the contact fingers 13, but a value of 1:2.8 should not be exceeded.

FIG. 2 illustrates the contact fingers 13 without any mechanical prestress. The contact surfaces 27 are in this case resting on a cylinder surface whose diameter is less than the external diameter of the contact pin 8 which interacts with it. The spreading of the contact fingers 13 which occurs in consequence when the contact fingers 13 run on the contact pin 8 produces the necessary contact force for the contact fingers 13. The smaller the diameter of the said cylinder surface is chosen to be, the greater is the contact force of the contact fingers 13. It is therefore possible to optimize this contact force very easily.

Figure 3:
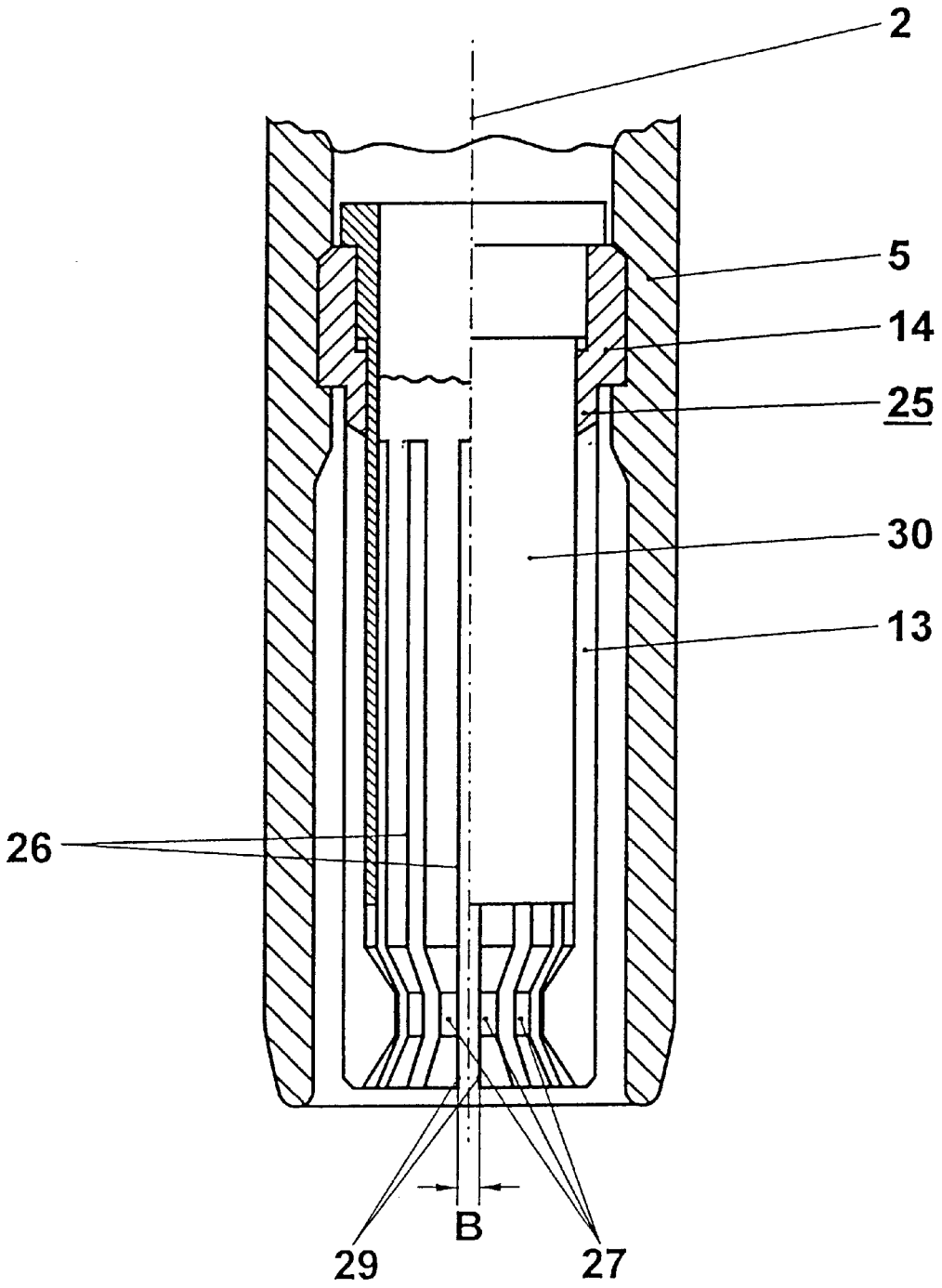
FIG. 3 shows a partial section through a second design variant of a contact arrangement of the electrical switching device.

FIG. 3 shows a partial section through the side of the contact tube 5 facing the mating contact 7. The holder 14 and the sprung contact fingers 13 which are integrally formed on it are illustrated as one item here, but can also be assembled from different parts. In the case of this further design variant of the moving contact arrangement of the quick-action grounding device 1, the contact fingers 13 are arranged in the form of a cylindrical finger cage 25. The finger cage 25 is mounted concentrically with respect to the central axis 2. Slots 26 which run radially with respect to the central axis 2 are produced between the individual contact fingers 13 and allow the contact fingers 13 to be sprung individually and independently of one another. These slots 26 have a constant width B over their entire length. The slots 26 have side edges 29. A cylindrical, metallic supporting sleeve 30 is pushed concentrically into the finger cage 25 and is screwed in with the holder 14. The insides of the contact fingers 13 rest on the supporting sleeve 30. A thin, temperature-resistant insulating sheet can be provided between the supporting sleeve 30, which is made of a heat-resistant steel, and the insides of the contact fingers 13, in order to avoid undefined current paths. Alternatively, it is possible to manufacture the supporting sleeve 30 from a temperature-resistant plastic, so that this additional insulating sheet can be omitted.

FIG. 3 illustrates the contact fingers 13 without any mechanical prestress. The contact surfaces 27 in this case lie on a cylinder surface whose diameter is less than the external diameter of the contact pin 8 which interacts with it. The spreading of the contact fingers 13 which occurs in consequence when the contact fingers 13 run on the contact pin 8 produces the required contact force for the contact fingers 13. The smaller the diameter of the said cylinder surface is chosen to be, the greater is the contact force of the contact fingers 13. It is therefore very easy to optimize this contact force.

When the quick-action grounding device is being connected, the moving contact tube 5 is moved toward the mating contact 7, to be precise at a speed that is as high as possible. On reaching the pre-arcing distance, a flashover first of all takes place between the tip 6 of the moving contact tube 5, and an arc is formed. If a high-current arc is formed, then the arc foot is so large that it can also act on the tips of at least some of the contact fingers 13. The contact fingers 13, which then each carry a comparatively high current, are drawn together by the electrodynamic forces which then occur.

In the case of the design variant according to FIG. 2, the contact fingers 13 can, however, be drawn together only until the side edges 28 of the narrower region A of the slots 26 touch one another. The side edges 29 of the front, broader region B of these slots 26 do not touch in this case, and can therefore not be welded together by the influence of the arc. In the design variant according to FIG. 3, in contrast, the metallic supporting sleeve 30 prevents the contact fingers 13 from being drawn together any further, so that, once again, their side edges 29 do not touch and can therefore not be welded to one another. Accordingly, the full functionality of the finger cage 25 is maintained with a high level of probability in both design variants.

As soon as the tips of the contact fingers 13 of the moving contact tube 5 touch the contact pin 8, the initial arc is quenched. The current now flows entirely through the contact fingers 13, and the finger cage 25 is then pushed up to the contact pin 8 by the force of the mechanical drive. Since it can be said with certainty that no force need be exerted to break welds between the contact fingers 13, the drive can be designed for comparatively small forces, and thus particularly economically.

The current path now leads temporarily from the contact fingers 13 of the moving contact tube 5 via the contact pin 8 and on through the mating contact 7 into the active part 4. The moving contact tube 5 therefore continues to move in the connection direction until the contact fingers 12 of the mating contact 7 are reliably resting on the outer surface of the moving contact tube 5. The majority of the current flowing through the quick-action grounding device 1 now flows from the moving contact tube 5, via the contact fingers 12, and on into the active part 4. The connection of the quick-action grounding device 1 is thus successfully complete.

If appropriately modified, the described contact arrangements can also be used in other switching devices, designed for comparatively high connection currents, in particular for circuit breakers, switch disconnectors etc., as well. The applicability of the contact arrangements according to the invention is also not limited to metal-encapsulated, gas-insulated switchboards. It is also possible to integrate the finger cage 25 in the stationary contact rather than in the moving contact. Even if both contacts of the switching device are designed as moving contacts, the described contact arrangements can be used advantageously. Furthermore, it is possible to design contact arrangements which have finger cages that are subject to a disconnection arc, corresponding to the finger cage 25 described here, so that welding cannot be caused between the side edges of the contact fingers here either as a result of electrodynamic forces in conjunction with the thermal effects of a disconnection arc.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrical switching device comprising:

a contact arrangement having at least one contact which moves along a central axis and at least one mating contact for receiving the moving contact, one of said at least one contacts having a finger cage including individual, sprung contact fingers spaced apart from one another by radial slots extending in a direction of the central axis, the contact fingers having a base and a front part including a contact surface, wherein the base of each contact finger is spaced from the base of an adjacent contact finger by a first predetermined distance and the front part of each contact finger is spaced from the front part of an adjacent contact finger by a second predetermined distance, the second predetermined distance being greater than the distance to substantially prevent side edges of the front part of the adjacent contact fingers from touching when said contact fingers are drawn together in the direction of the central axis as a result of arc effects.

2. The electrical switching device as claimed in claim 1, wherein the radial slots include a first width and a second width, the second width being greater than the first width, the first width being defined between the base of adjacent contact fingers and the second width being defined between the front part of adjacent contact fingers.

3. The electrical switching device as claimed in claim 1, wherein a mean diameter of the finger cage has a ratio of about 100:1 to the width of the slots originating from the base of the contact fingers, and wherein the mean diameter of the finger cage has a ratio of about 1:3 to a length of the contact fingers.

4. The electrical switching device as claimed in claim 3, wherein the mean diameter of the finger cage has a maximum ratio of about 1:2.8 to the length of the contact fingers.

5. The electrical switching device as claimed in claim 1, further comprising a cylindrical supporting sleeve which is fitted into the finger cage.

6. The electrical switching device as claimed in claim 5, wherein the supporting sleeve is manufactured from a temperature-resistant plastic.

7. The electrical switching device as claimed in claim 5, wherein the supporting sleeve is manufactured from a heat-resistant steel.

8. The electrical switching device as claimed in claim 7, wherein electrical insulating, temperature-resistant insulation is provided between the supporting sleeve and the finger cage.

9. The electrical switching device as claimed in claim 1, wherein said switching device is designed as a grounding device, a quick-action grounding device, a circuit breaker or a switch disconnector.

* * * * *